US010119293B1

(12) United States Patent
McCugh

(10) Patent No.: US 10,119,293 B1
(45) Date of Patent: Nov. 6, 2018

(54) REMOVABLE UTILITY GROUND POST

(71) Applicant: Darrin McCugh, Kingsport, TN (US)

(72) Inventor: Darrin McCugh, Kingsport, TN (US)

( * ) Notice: Subject to any disclaimer, the term of this patent is extended or adjusted under 35 U.S.C. 154(b) by 9 days.

(21) Appl. No.: 14/999,073

(22) Filed: Mar. 28, 2016

Related U.S. Application Data

(63) Continuation-in-part of application No. 13/987,888, filed on Sep. 12, 2013, now abandoned.

(51) Int. Cl.
*E04H 12/22* (2006.01)

(52) U.S. Cl.
CPC ..... *E04H 12/2215* (2013.01); *E04H 12/2253* (2013.01)

(58) Field of Classification Search
CPC ..... E04H 12/2215; E04H 12/2253; E04H 17/263; E04H 15/62; E02D 5/80
USPC ..... 248/530, 545, 156; 40/607.05; 52/155
See application file for complete search history.

(56) References Cited

U.S. PATENT DOCUMENTS 299,086 A * 5/1884 Over ..... B25D 1/16 173/90
394,854 A * 12/1888 Helfenberger et al. ..... E21B 15/00 256/DIG. 2
444,497 A * 1/1891 Lounsberry ..... E04H 12/2215 52/165
606,558 A * 6/1898 Ketchum ..... E04H 12/2215 248/156
1,142,046 A * 6/1915 Michod ..... E04H 12/2215 52/154
1,649,249 A * 11/1927 Newman ..... E01F 9/623 40/607.08
2,022,160 A * 11/1935 Sorensen ..... G09F 7/20 40/607.06
2,067,890 A * 1/1937 Collord ..... E04H 17/263 173/126
2,282,049 A * 5/1942 Haggart, Jr. ..... E02D 13/10 405/244
2,759,486 A * 8/1956 Pesaturo ..... E04H 12/2215 135/16
3,519,234 A * 7/1970 Matson ..... E04H 12/2215 144/195.5
4,101,088 A * 7/1978 Stauth ..... E04H 17/263 144/195.5
4,249,715 A * 2/1981 Repp ..... E01F 9/685 248/156
4,279,104 A * 7/1981 Classen ..... E01F 9/685 52/165

(Continued)

*Primary Examiner* — Ingrid M Weinhold
(74) *Attorney, Agent, or Firm* — Leason Ellis LLP

(57) ABSTRACT

A support post structure comprising an elongated impact drive tube having a longitudinally extending bore open at a distal end of the tube, an elongated stake member having a guide section slidably mounted within the bore and further having a ground penetrating elongated head section extending longitudinally outward from the distal end of the drive tube, wherein the head section in cross-section has a channel configuration with a web base and parallel upstanding side walls, the head section has a driven lateral shoulder adapted for being downwardly impacted by the distal end of the tube on the down stroke of the tube, and wherein the head section is wedge shaped with the point of the wedge on the distal end of the web base and with the lateral driven shoulder on upper portions of the channel sides at a proximal end of the head section.

9 Claims, 3 Drawing Sheets

(56) References Cited

U.S. PATENT DOCUMENTS 4,459,787 A * 7/1984 Wilcox ..... E02D 5/80 135/15.1
4,910,901 A * 3/1990 Boyar ..... G09F 7/22 40/606.19
5,020,605 A * 6/1991 Leishman ..... E04H 17/263 173/1
5,042,591 A * 8/1991 Hull ..... B25D 1/16 173/132
5,050,828 A * 9/1991 Wolff ..... E04H 12/2215 248/156
5,067,683 A * 11/1991 Wager ..... F41J 1/10 248/156
5,104,265 A * 4/1992 Halloran, Jr. ..... E04H 12/2215 405/244
D332,821 S * 1/1993 Padilla ..... D22/147
5,699,864 A * 12/1997 Dvorak ..... E04H 12/2215 173/128
6,338,465 B1 * 1/2002 Stoner ..... A01K 97/10 248/156
6,481,364 B2 * 11/2002 Woyjeck ..... A01K 1/04 114/230.1
D470,189 S * 2/2003 Nguyen ..... D20/41
6,719,249 B2 * 4/2004 MacIntyre ..... A45F 3/44 248/156
6,752,362 B1 * 6/2004 Gretz ..... E04H 12/003 248/156
7,089,694 B2 * 8/2006 Allen ..... G09F 15/0037 173/126
7,520,485 B1 * 4/2009 Giannetto ..... A01K 97/10 173/91
7,934,567 B1 * 5/2011 Madey ..... E04H 17/263 173/132
2002/0007775 A1 * 1/2002 Woyjeck ..... A01K 1/04 114/294
2009/0071069 A1 * 3/2009 Conde ..... E04H 12/2215 47/33
2010/0133492 A1 * 6/2010 Langenwalter ..... E04H 12/2215 256/47
2011/0253876 A1 * 10/2011 Odell ..... E04H 12/2215 248/530
2015/0048232 A1 * 2/2015 Hallauer ..... E04H 12/2215 248/532

* cited by examiner

REMOVABLE UTILITY GROUND POST

CROSS-REFERENCE TO RELATED APPLICATIONS

This application is a continuation-in-part application of pending Ser. No. 13/987,888 filed Sep. 12, 2013 entitled Removable Utility Ground Post and claims priority also under 35 U.S.C. 119(e)(1) on Applicants Provisional U.S. Patent Application Ser. No. 61/685,959 filed Mar. 28, 2012 entitled Removable Utility Ground Post.

STATEMENT REGARDING FEDERALLY SPONSORED RESEARCH OR DEVELOPMENT

N/A

THE NAMES OF THE PARTIES TO A JOINT RESEARCH AGREEMENT

N/A

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

N/A

STATEMENT REGARDING PRIOR DISCLOSURES BY THE INVENTOR OR A JOINT INVENTOR

N/A

BACKGROUND OF THE INVENTION

Field of the Invention

This invention is in the structure of a post which can be driven easily into the ground and easily extracted from the ground, and which can be used to support a variety of items such as fence wire, mail boxes, signs such as real estate, construction tool boxes and construction electrical power outlets, gardening equipment, lawn party lights, and the like, wherein removal and replacement of the post from one work area to another is made easy by means of its unique structure.

Description of Related Art Including Information Disclosed Under 37 CFR 1.97 and 1.98

N/A

BRIEF SUMMARY OF THE INVENTION

A support post structure comprising an elongated impact drive tube having a longitudinally extending bore open at a distal end of said tube, an elongated stake member having a guide section slidably mounted within said bore and further having a ground penetrating elongated head section extending longitudinally outward from said distal end of said drive tube, wherein said head section in cross-section has a channel configuration with a web base and parallel upstanding side walls, said head section has a driven lateral shoulder adapted for being downwardly impacted by said distal end of said tube on the down stroke of said tube, and wherein said head section is wedge shaped with the point of the wedge on the distal end of said web base and with said lateral driven shoulder on upper portions of the channel sides at a proximal end of said head section.

BRIEF DESCRIPTION OF THE SEVERAL VIEWS OF THE DRAWINGS

The invention will be understood further from the following drawings wherein.

DETAILED DESCRIPTION OF THE INVENTION

Figure 1:
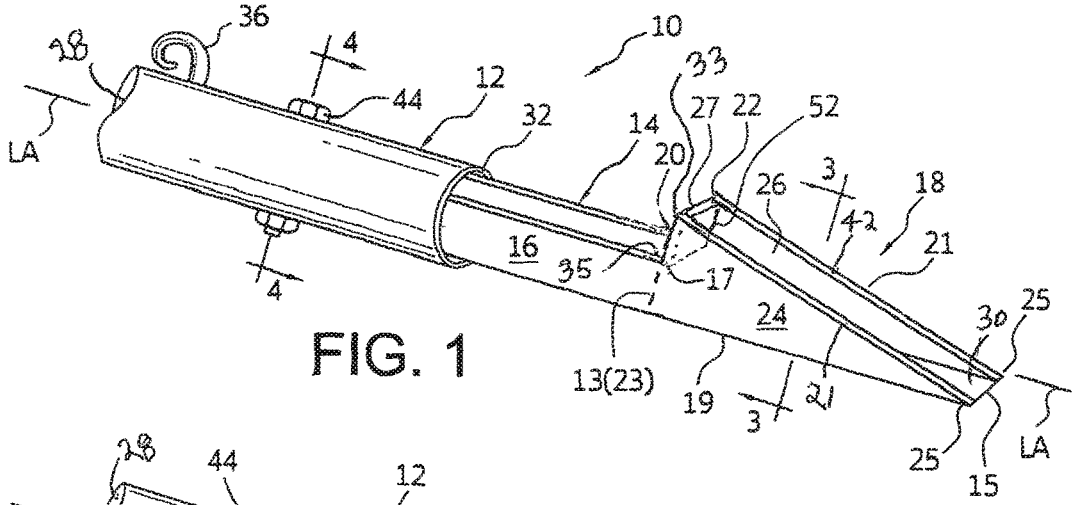
FIG. 1 is an isometric view of the present post.
Figure 2:
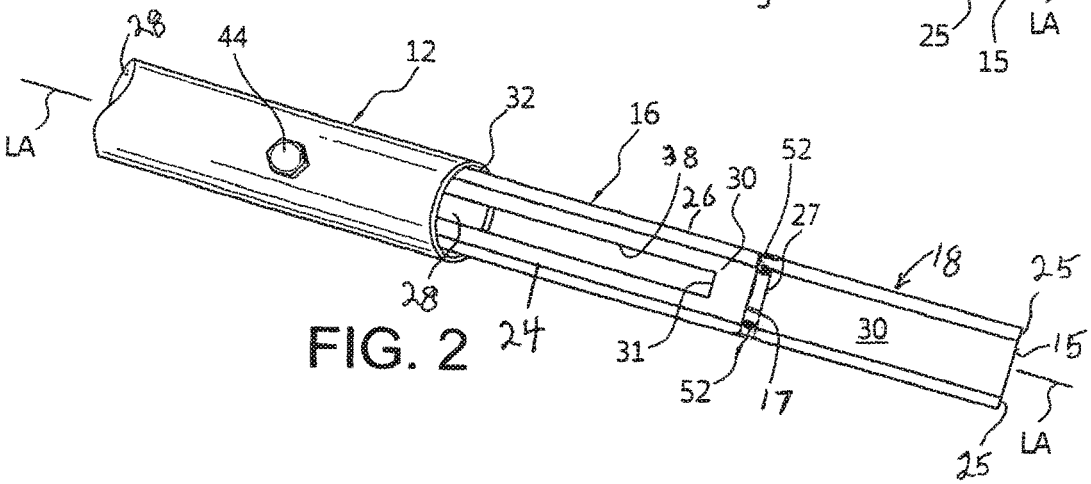
FIG. 2 is an isometric view of the post as in FIG. 1 wherein the post is rotated about 80° on its longitudinal axis "LA" in the counterclockwise direction "CC" in FIG. 1.
Figure 3:
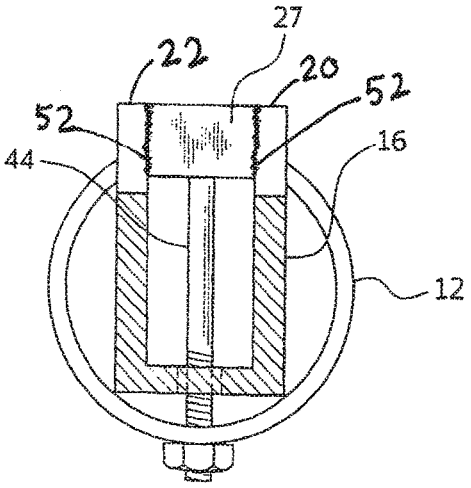
FIG. 3 is a cross-sectional view of the post taken along line 3-3 in FIG. 1.
Figure 4:
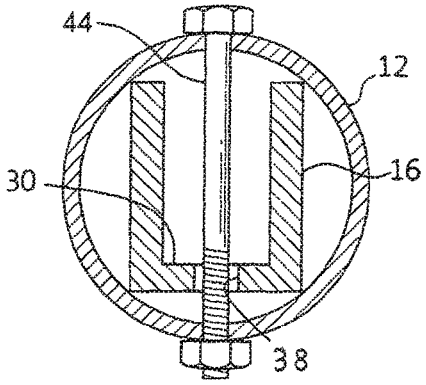
FIG. 4 is a cross-sectional view of the post taken along line 4-4 in FIG. 1.

The present utility post construction 10 having a longitudinal axis "LA" described in one preferred embodiment of FIGS. 1-4, as comprising an outer steel drive tube 12 and a ground penetrating steel stake member 14 having a guide section 16 and a head section 18 having a proximal phantom end 13 and a distal end 15. The stake member is formed preferably with a Channel (e.g., U-shaped) and wedge configuration, the head section having impact drive shoulders 20, 22 on its side walls 24, 26 respectively, said side walls each having a bottom edge 19, a top edge 21 formed on a diagonal 42, a phantom juncture edge 23 and a distal tip edge 25. A bore 28 extends through the outer steel device tube 12. The guide section 16 having side walls 24, 26 with top edges 35, a distal end 17 and a free (lost) motion power slot 38 formed thru its web base 30. Slot 38 has a proximal end 39 and a distal end 31. The web base 30 extends the full length of the stake member 14. It will therefore be appreciated that the side walls 24, 26 extend outwardly from the web base 30 and are parallel to one another and the head section 18 can be thought of as having a proximal portion and a distal portion, wherein side walls 24, 26 of the proximal portion extend out farther from the web base 30 than sidewalls 24, 26 of the guide section 16 in order to create the impact drive shoulders 20, 22 that are formed at a substantially right triangle to the web base 30.

Figure 6:
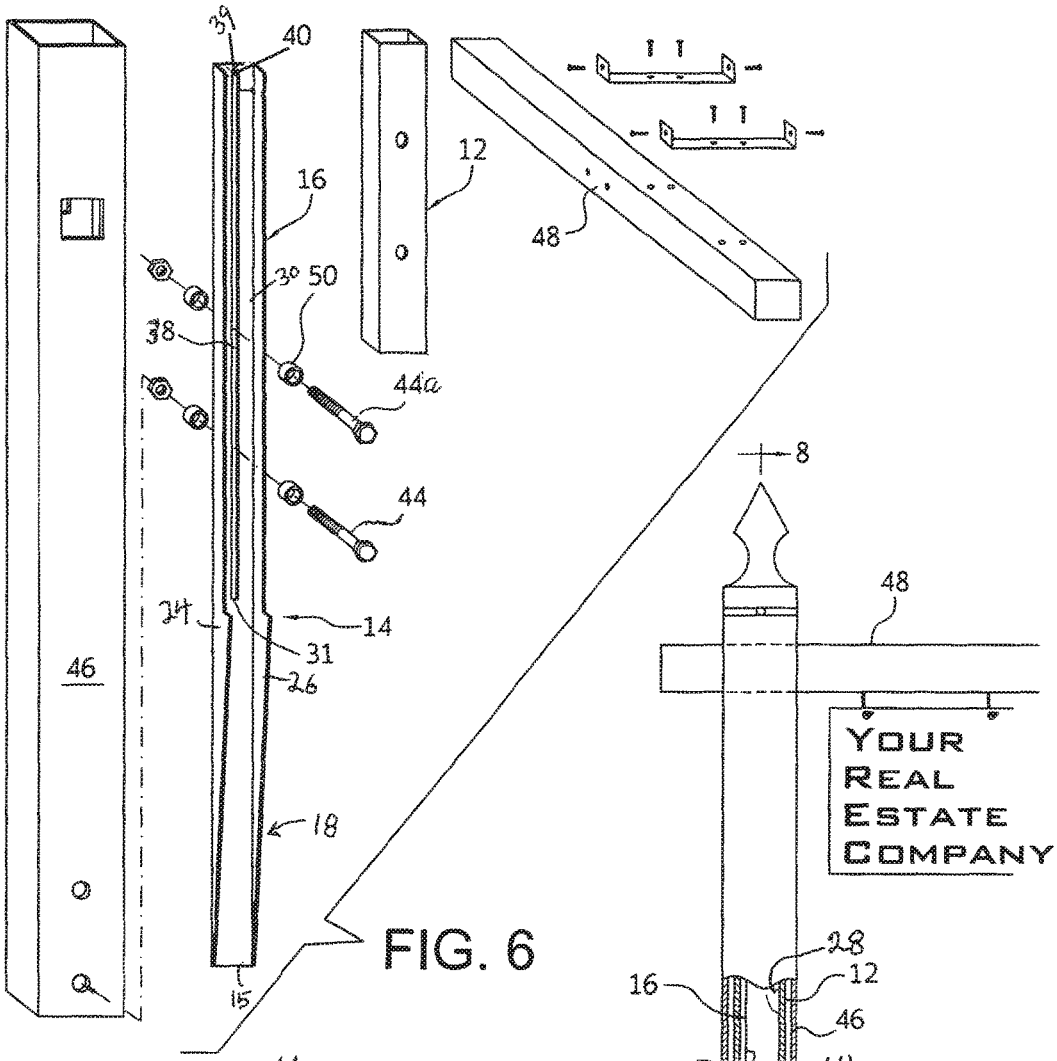
FIG. 6 is an exploded view of the mail box post embodiment components of FIG. 5.
Figure 7:
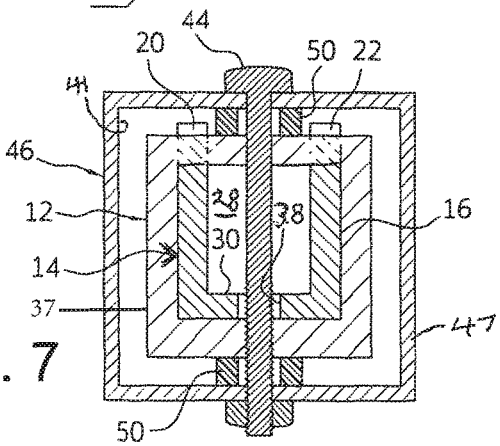
FIG. 7 is a lateral cross-sectional view of the mail box post embodiment taken along line 7-7 in FIG. 5.
Figure 5:
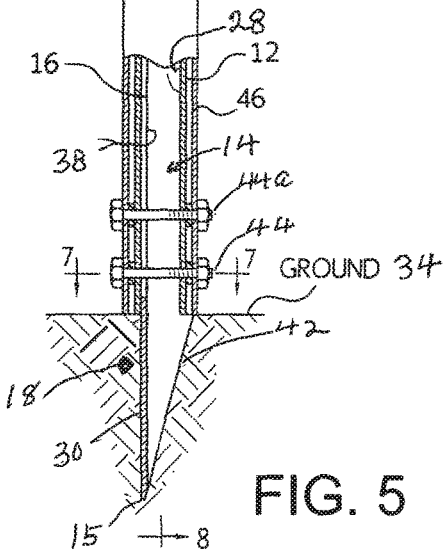
FIG. 5 is a partial cross-sectional view of the present post fitted out with a mail box support stanchion means.
Figure 8:
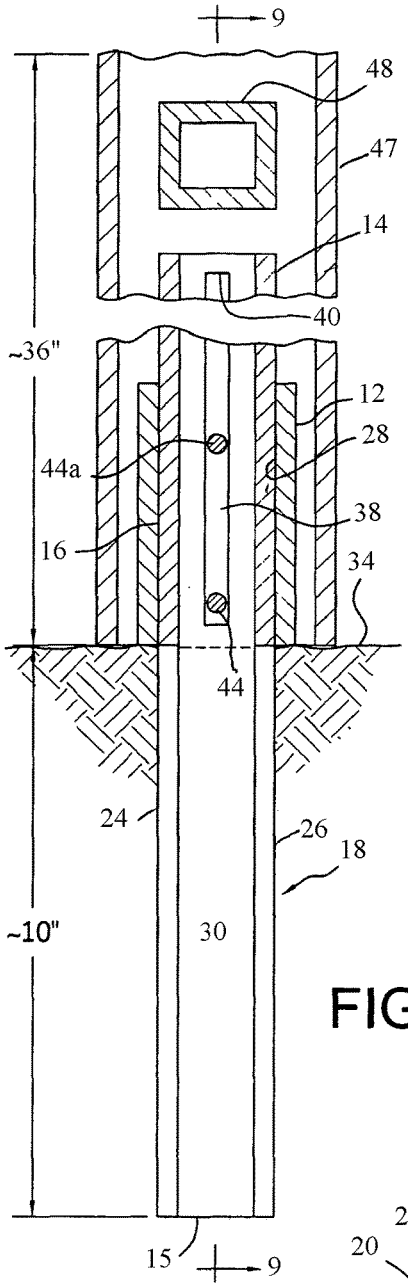
FIG. 8 is a longitudinal cross-sectional view of the mail box post embodiment taken along longitudinal axis 8 in FIG. 5.
Figure 9:
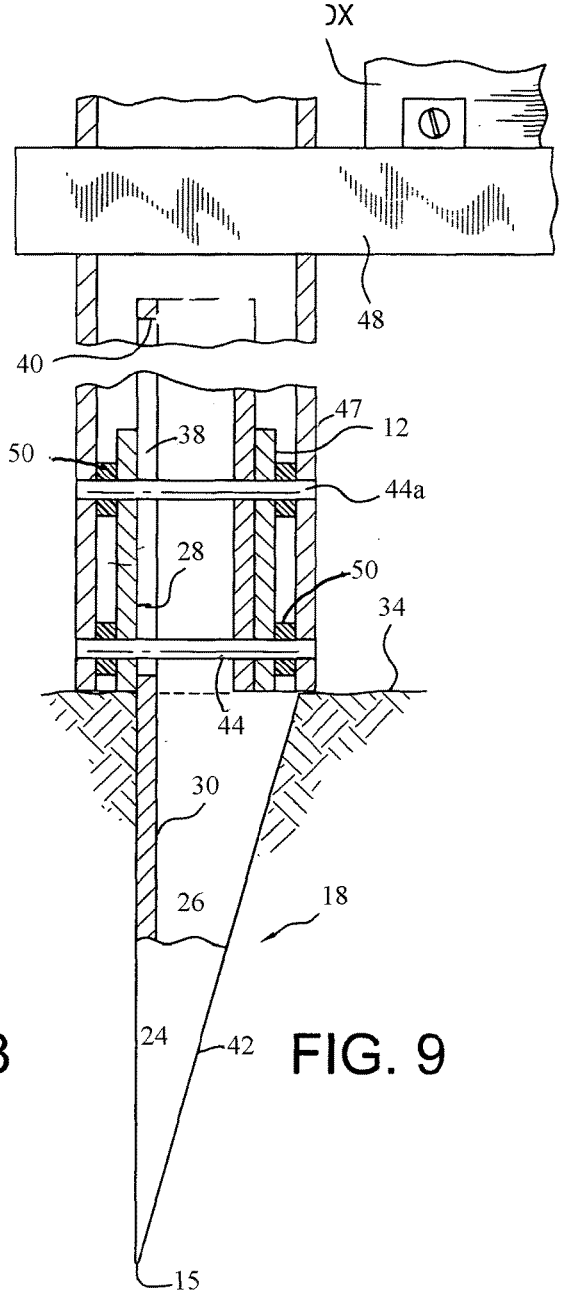
FIG. 9 is a longitudinal cross-sectional view taken along line 9-9 in FIG. 8.
Figure 10:
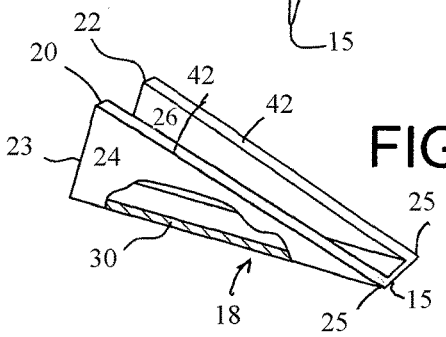
FIG. 10 is a perspective view of a preferred head section.

The drive tube 12 is shown as a round steel tube but can have, e.g., a square or rectangular cross-section as shown in FIG. 6. The diameter or lateral dimensions of 12 should be sufficient only to allow the distal end 32 of drive tube 12 to strike against shoulders 20, 22 of head section 18 and drive the head section into the ground 34. Preferably, an impact plate 27 is welded as at 52 to and between shoulders 20 and 22 to strengthen the shoulders and the head section 18 overall. Any type of hook or bracket or the like 36 may be provided on 12 or on any facade member such as 46 described below for supporting barbed wire or other items.

The proximal end 39 of power slot 38 terminates at an extraction shoulder 40 which is impacted during the stake member extraction (upward throw of drive tube 12) by a pin or bolt 44, 44*a* or any structural equivalent slidable in slot 38 and fixed to drive tube 12.

Referring to FIGS. 5 thru 9, the outer wall 37 of steel drive tube 12 is spaced from the inner wall of 41 a facade member 46 such as a sign or mail box support stanchion 47 which carries, e.g., arm 48 as shown in FIGS. 5-9 by spacers 50 and secured to 46 by, e.g., said bolts or pins 44 and 44*a*.

A very important advantage of the present construction is that the open channel configuration facilitates insertion of head section 18 into the ground while affording considerable lateral stability to the post. In this regard, the open channel and wedge shape of 18 minimizes the frictional forces generated during insertion into and extraction of the head from the ground as compared to the frictional forces generated by solid or tubular configurations of the head section while providing the necessary lateral stability for maintaining the post in an upright posture.

The invention has been described in detail with particular reference to preferred embodiments thereof, but it will be understood that variations and modifications will be effected within the spirit and scope of the invention.

I claim:

1. A utility support post structure comprising:

an elongated impact drive tube having a longitudinally extending bore open at a distal drive end of said drive tube;

an elongated stake member in a form of a U-shaped channel member having a guide section slidably mounted within said bore and further having a ground penetrating elongated head section extending longitudinally outward from said distal drive end of said drive tube, said head section and said guide section being a single piece and having a U-shaped channel configuration in cross-section with a common web base and common parallel side walls that extend outwardly from the web base such that an open U-shaped channel extends continuously along the head section and along the guide section, the head section having a proximal portion and a distal portion, wherein the side walls of the proximal portion extend out farther from the web base than the side walls of the guide section in order to create impact drive shoulders that are formed at a substantially right triangle to the web base, wherein the side walls of said head section are wedge shaped to enhance penetration of said head section into the ground upon striking said impact drive shoulders with said distal drive end of said drive tube.

2. The post structure of claim 1 wherein a fastener couples the drive tube to the elongated stake member and an extraction shoulder is provided on said guide section for impacting the fastener on an upstroke of said drive tube for extracting said head section from the ground.

3. The post structure of claim 2 wherein a facade structure is placed over said drive tube and wherein said drive tube is fastened to said façade structure whereby down and up movement of said facade structure can respectively force said head section into and out of the ground.

4. The post structure of claim 2 wherein an elongated longitudinally oriented slot having a proximal end and a distal end is formed in said web base of said guide section, wherein said proximal end provides said extraction shoulder and wherein the fastener comprises a bolt affixed to said drive tube and passing generally laterally through said slot and slidable within said slot as said drive tube is moved up and down relative to said stake member.

5. The post structure of claim 1 wherein the entire length of said stake member comprises a unitary piece of steel having the web base and the parallel side walls, wherein the parallel side walls of said guide section are of uniform height throughout their lengths.

6. The post structure of claim 1 wherein said drive tube is circular in cross-section and wherein said impact drive shoulders defined by said side walls of said head section extend outwardly past a radius of said drive tube.

7. The post structure of claim 1 wherein a cross-sectional shape of the drive tube is different than the U-shaped channel configuration in cross-section of the guide section.

8. The post structure of claim 1 wherein less than an entire bottom edge of the distal drive end of the drive tube contacts the impact drive shoulders when the drive tube is in contact with the impact drive shoulders.

9. A utility support post structure comprising:

an elongated impact drive tube having a longitudinally extending bore open at a distal drive end of said drive tube;

an elongated stake member having a guide section slidably mounted within said bore and further having a ground penetrating elongated head section extending longitudinally outward from said distal drive end of said drive tube, said head section and said guide section being formed as a single piece and having a channel construction in cross-section with a common web base and common parallel side walls that extend outwardly from the web base such that a U-shaped open channel extends continuously from a distal end of the head section to a proximal end of the guide section, wherein the head section has a proximal portion and a distal portion, wherein the side walls of the proximal portion extend out farther from the web base than the side walls of the guide section so as to form shoulders that define an impact drive surface for engagement with the distal drive end of the drive tube, the impact drive surface being formed at a substantially right triangle relative to the web base, wherein a top edge of each side wall of said head section lies on a diagonal relative to said web base resulting in said side walls of said head section being wedge shaped to enhance penetration of said head section into the ground upon striking said impact drive surface with said distal drive end of said drive tube, wherein the web base of the guide section includes an elongated slot that is formed in a longitudinal direction and receives a bolt that is connected to and extends across the bore of the drive tube resulting in the drive tube and the elongated stake member being slidably coupled to one another, the elongated slot being located within the U-shaped open channel of the guide section and terminating at a location that is spaced in a proximal direction from the impact drive surface, wherein an impact plate is attached to the side walls of the head section and extends therebetween, the impact plate at least partially closing off the U-shaped open channel construction of the head section, the impact plate partially defining the impact drive surface.

* * * * *